US006109808A

United States Patent [19]

Susini et al.

[11] Patent Number: 6,109,808

[45] Date of Patent: Aug. 29, 2000

[54] ROTARY CASE FOR LIPSTICK AND THE LIKE WITH AXIAL CLEARANCE ADJUSTMENT

[75] Inventors: Claude Susini, Sennecey-le-Grand; Olivier Lecomte, Chêne en Semine, both of France

[73] Assignee: Reboul, Rexam, Cran Gevrier, France

[21] Appl. No.: 09/011,272

[22] PCT Filed: Aug. 2, 1996

[86] PCT No.: PCT/FR96/01235

§ 371 Date: Mar. 27, 1998

§ 102(e) Date: Mar. 27, 1998

[87] PCT Pub. No.: WO97/05801

PCT Pub. Date: Feb. 20, 1997

[30] Foreign Application Priority Data

Aug. 10, 1995 [FR] France ..... 95 09738

[51] Int. Cl.[7] ..... B43K 21/08

[52] U.S. Cl. ..... 401/78; 401/80

[58] Field of Search ..... 401/78, 80, 49, 401/54, 55

[56] References Cited

U.S. PATENT DOCUMENTS

| | | | |
|---|---|---|---|
| 2,333,889 | 11/1943 | Ruekberg | 401/78 |
| 2,444,376 | 6/1948 | Seaver | 401/78 |
| 2,840,229 | 6/1958 | Hopgood . | |
| 4,812,066 | 3/1989 | Gueret | 401/78 |
| 5,096,318 | 3/1992 | Susini et al. | 401/80 |
| 5,234,275 | 8/1993 | Gueret | 401/80 X |
| 5,348,410 | 9/1994 | Shozi et al. . | |

FOREIGN PATENT DOCUMENTS

| | | | |
|---|---|---|---|
| 0 491 579 A1 | 6/1992 | European Pat. Off. . | |
| 0 658 325 A1 | 6/1995 | European Pat. Off. . | |
| 2670998 | 7/1992 | France | 401/80 |
| 295 05 492 | 7/1995 | Germany . | |
| 1058176 | 9/1964 | United Kingdom | 401/78 |
| WO 86/03658 | 7/1986 | WIPO . | |
| WO 95/07639 | 3/1995 | WIPO . | |

*Primary Examiner*—David J. Walczak
*Attorney, Agent, or Firm*—Hoffmann & Baron, LLP

[57] ABSTRACT

A case for lipstick and similar materials with respectively rotating concentric tubes with axial movement of cup-slider (2) which bears stick (1) of pasty substance, characterized by the fact that it has a device for braking with respect to rotation and compensation for axial play between the tubes consisting of flange (10), added on or not, connected to the base of internal tube (5) and having at least one flexible extension (14) which bears elastically against edge (15) of the base of external tube (7).

11 Claims, 3 Drawing Sheets

FIG_1
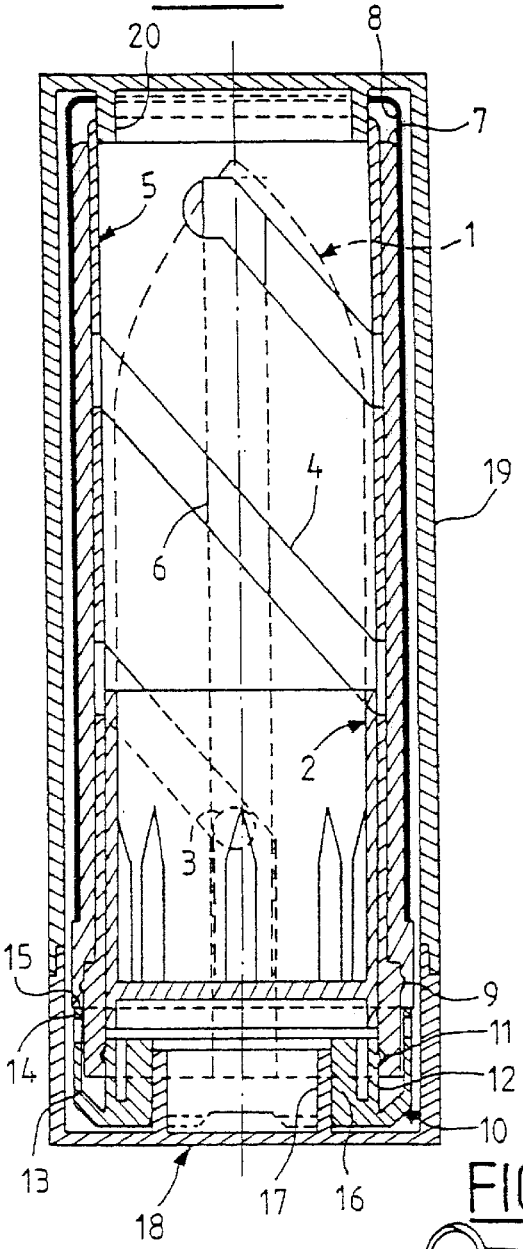
FIG_6
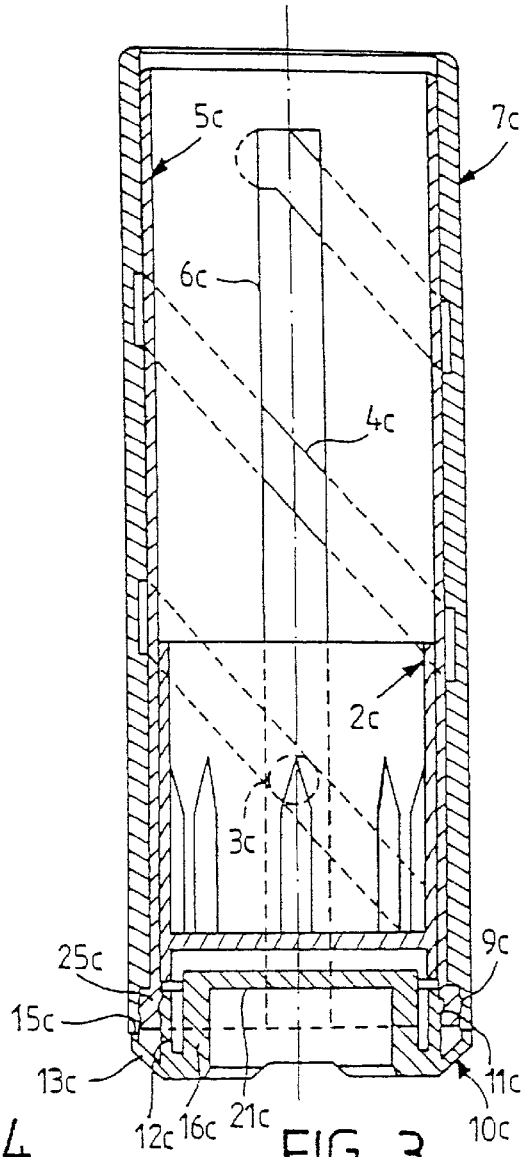
FIG_4
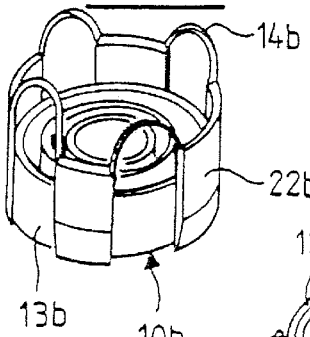
FIG_3
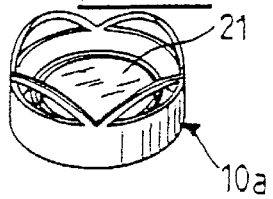
FIG_2
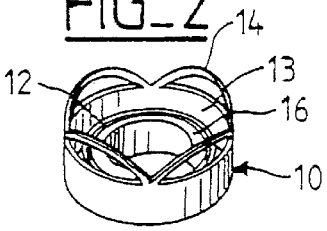
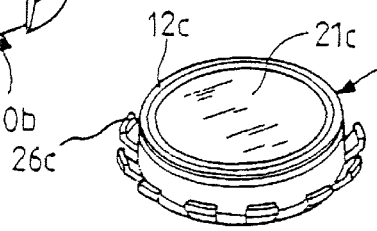
FIG_7

ROTARY CASE FOR LIPSTICK AND THE LIKE WITH AXIAL CLEARANCE ADJUSTMENT

FIELD OF INVENTION

The present invention concerns the packaging industry and more particularly it concerns cases for storage and manipulation of sticks of pasty or friable material which are to be applied by rubbing onto a solid surface, such as lipstick or another cosmetic, makeup pencils, marking pens, medicated sticks, or adhesive stocks.

BACKGROUND OF INVENTION

Cases have ordinarily been used for a long time in which the stick is maintained by its base in a cup-slider which is slid axially, as needed, in order to make the free end of the stick come out of the case or to return it there. This sliding can be brought about simply by moving with a finger a lateral push button that is connected to the cup-slider and that projects outward from a longitudinal slit in the case. But most often, one uses a rotary mechanism with two cooperating concentric tubes, respectively hollowed with two spiral grooves, in one case, and in the other case, with two longitudinal slits reciprocally passed through by two radial pins connected to the cup-slider.

The customer appreciates a smooth and regular operation of the rotating mechanisms, which implies minimal play between the moving elements and a controlled force of displacement. The unavoidable mechanical tolerances of the industrially molded parts which generally constitute all or almost all of the elements of these mechanisms do not allow these objectives to be fully attained. Braking devices, with or without compensation for play, are therefore used. Numerous devices have been proposed with radial braking runners inserted between the two tubes, such as those described in the French Patents Nos. 1,417,277, 2,657,238, 2,670,998, which can provide suitable braking and good centering of the tubes, but which have no effect on the axial play, which is much more difficult to control than the diametral play. In order to compensate for the axial play, cylindrical groove-frustrum-shaped circular rib assemblies have been proposed, as in the French Patent No. 2,169,557, which can provide good axial fixing but without elasticity, therefore to the detriment of the regular and smooth manipulation of the mechanism.

SUMMARY OF INVENTION

The aim of the invention is a rotating mechanism which does not have the disadvantages of the prior mechanisms, and which is reliable, has a regular and smooth functioning suited to the needs of industrial manufacturing and assembly, and which is inexpensive.

The invention concerns a case for lipstick and similar materials with respectively rotating concentric tubes with axial movement of a cup-slider which bears a stick of pasty substance, of the type which has a device for braking with respect to rotation and compensation for axial play between the tubes consisting of a flange, added on or not, connected to the base of the internal tube and having at least one flexible extension which bears elastically against the edge of the base of the external tube, characterized by the fact that the tubes are connected together by nonlocking mutually corresponding catches near the flange-internal tube connection.

The flange can be an added part fastened to the internal tube by a catch, or by gluing, welding or force-fitting.

It advantageously has a cross section in the form of a U, V, or W, one lateral arm of which is flexible and possibly toothed.

In order to produce sealed cases, the flange, or the internal tube, has a solid bottom.

The assembly of the mechanism with an exterior envelope is facilitated if the flange, or the internal tube has an axial tubular part, of which at least the lower end is open, for receiving the tube cap of a decorative envelope for the case.

In one embodiment, the top of the external lateral wall of the flange has overlying elastic arches.

In a variant, the flange is in the form of a ring surrounded by teeth parallel to the axis, whose free ends are joined by elastic arches.

According to another embodiment, the base of the flange with a cross section in the form of a curved U is connected to a tubular extension of the base of the interior tube, the lateral arm of the U on the tube side, possibly cut with teeth, bears elastically at its free edge, which is possibly reinforced, against the edge of the exterior tube, whereas the arm of the U which is not cut has an edge beveled towards the exterior.

According to yet another embodiment, the flange has a general cross section in the form of a V whose interior arm, which is solid, is connected to a tubular extension of the base of the interior tube, whereas the exterior arm, possibly cut with elastic teeth, bears, at its free end, against an exterior frustrum-shaped part of the edge of the end of the external tube.

With the same elements, it is possible to produce mechanisms with which the braking in terms of rotation between tubes differs, where the flange is a joined part fastened to a tubular extension of the internal tube a distance from the edge of the external tube which is determined by the extent of the desired force of friction of the elastic teeth of the flange.

In an original mode of construction, the internal wall of the external tube is formed with two diametrically opposing longitudinal grooves opening only at the base of the tube, whereas the internal tube is formed with two diametrically opposing spiral slits, each opening only at one end by a longitudinal slit extended by a groove formed in the internal wall of the reinforced continuous circular end of the internal tube.

In this case, in order to ensure possibly a better holding of the cup-slider in the slits and grooves of the tubes, the lateral walls of these slits and grooves have triangular cross sections complementary to those of two diametrically opposing tongues of the cup-slider and which mutually fit together for the axial movement of the cup-slider by relative rotation of the tubes.

It is generally advantageous that the flange and the tubes be of different materials in order to obtain improved properties of reciprocal friction and elasticity: for example, the tubes can be molded out of polypropylene with or without a charge, or of polystyrene, whereas the flange can be molded out of polyoxymethylene, high-density polyethylene, or a fluorinated polymer.

The invention can be more clearly understood by examination and the detailed description of the appended drawings which represent a few embodiments chosen simply as examples from among the numerous forms of execution, adaptations and variants of the invention which can be conceived by an experienced technician.

BRIEF DESCRIPTION OF THE DRAWINGS

FIG. 1 is a diagrammatic front view in axial section of a case according to the invention;

FIG. 2 is a perspective view of the flange of the case of FIG. 1;

FIG. 3 is a view similar to that of FIG. 2 of a variant with a solid bottom of the same flange;

FIG. 4 is a view similar to that of FIG. 2 of another variant of the same flange;

FIG. 6 is a diagrammatic front view in axial section of another case mechanism according to the invention;

FIG. 7 is a perspective view of the flange of the mechanism of FIG. 5;

In these figures, the corresponding elements are designated by the same numerical references, possibly assigned an index. The dimensions and the respective proportions of these elements may not be complied with for better legibility of the drawings.

DETAILED DESCRIPTION OF THE PREFERRED EMBODIMENTS

Figure 5:
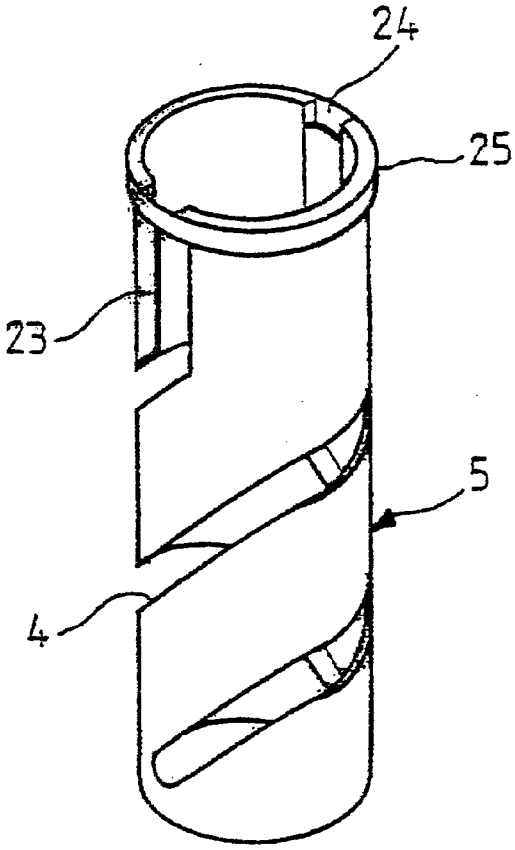
FIG. 5 is a perspective view of the internal tube of the case of FIG. 1.

The case for lipstick or the like, represented in FIG. 1, essentially includes stick 1 of a cosmetic or other pasty material, represented by a broken line, whose base is housed in cup-slider 2 provided on the outside with two diametrically opposing radial tongues 3, represented by dotted lines, sliding respectively through one of two opposing spiraled slits 4 of internal tube 5, as well as, by their respective ends, in one of two opposing internal longitudinal grooves 6 of external tube 7 which is coaxial with internal tube 5. Tubular metallic sleeve 8, open at its top, is fit over the external tube. The two tubes are connected together towards their base by nonlocking catches 9 which leave them free to mutually rotate with a small amount of axial play. Flange 10 with a cross section in the form of a W is attached by locking catching device 11 or welding, or gluing of its median wall 12 inside of the free end of internal tube 7. External wall 13 of the flange is extended by flexible arches 14, numbering four in this example, which bear elastically at their tops against edge 15 of the free end of the base of external tube 7, thus providing compensation for axial play between the two tubes, as well as flexible braking of their mutual rotation.

Each of the spiraled slits 4 of internal tube 5 opens at its base in a longitudinal slit section 23 extended by groove 24 formed in the internal wall of the reinforced continuous circular end 25 of the tube. This structure provides good rigidity of the internal tube (FIG. 5) in spite of the cuts of its lateral wall.

In the internal axial tubular part of internal wall 16 of the flange, force-fit, or glued, or welded, or caught, or otherwise locked, there is an axial internal tubular extension 17 of the base of cap 18 of a decorative envelope of the case completed by cover 19 whose bottom has axial tubular extension 20 inside, which is fit with gentle friction inside of the free opening of internal tube 5.

Flange 10*a*, represented as a variant in FIG. 3, differs from that of FIG. 2 only by the closing of the top of the internal wall of the flange by wall 21 which thus provided a sealed closing of the base of internal tube 5.

The other variant of flange 10*b* represented in FIG. 4 is connected on the case of FIG. 1 in the same way as flanges 10 and 10*a* of FIGS. 2 and 3. In this variant, arches 14*b* connect the free ends of teeth 22*b* regularly distributed in a ring projecting from external wall 13*b* of the flange. This structure facilitates molding. The case mechanism according to the invention represented in FIG. 6 essentially includes elements similar to those of the case of FIG. 1. Except that it does not have a metallic sleeve; external tube 7*c* is formed with two opposite helicoidal grooves 4*c* whereas internal tube 5*c* is formed with two opposing longitudinal slits 6*c*.

This arrangement opposite that of the tubes of the case of FIG. 1 functions in the same way in order to ensure the translation of cup-slider 2*c* by its tongues 3*c*. The two tubes 5*c* and 7*c* are connected at their base by nonlocking catching device 9*c*, whereas flange 10*c* with blind bottom 21*c*, with a W-shaped cross section, is connected to the end of internal tube 5*c* by locking connection 11*c* with its median wall 12*c*. External wall 13*c* of the flange is cut with a number of flexible teeth 26*c* whose free ends bear elastically against edge 15*c* of the end of external tube 7*c*. In this example, annually reinforced end 25*c* of the internal tube ensures both the free connection 9*c* with the external tube and the locked fastening 11*c* with the internal tube.

Figure 8:
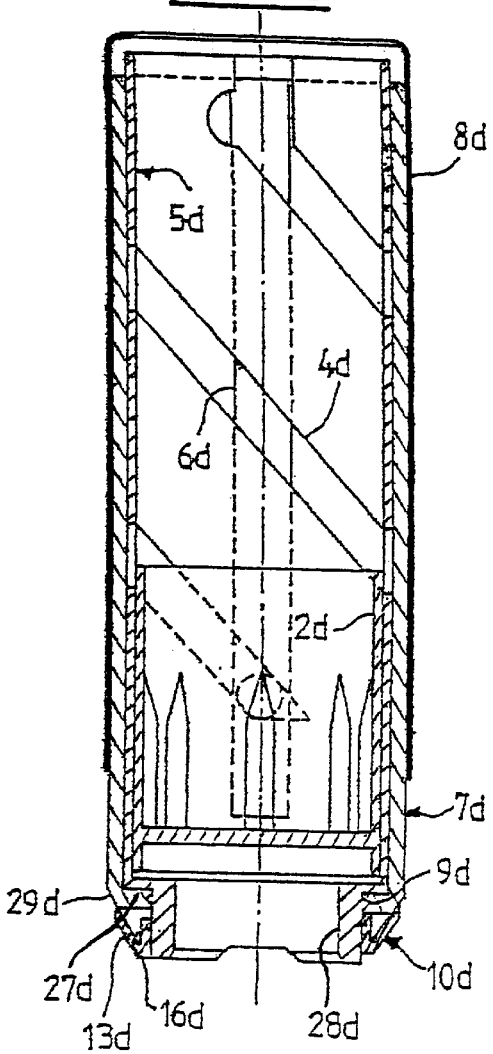
FIG. 8 is a diagrammatic front view in axial section of a variant of a case mechanism according to the invention.
Figure 9:
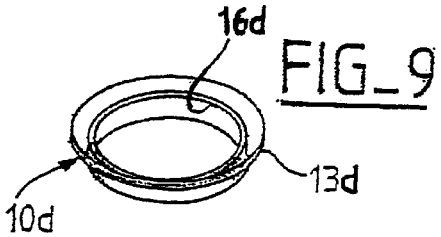
FIG. 9 is a perspective view of the flange of the mechanism of FIG. 8.
Figure 10:
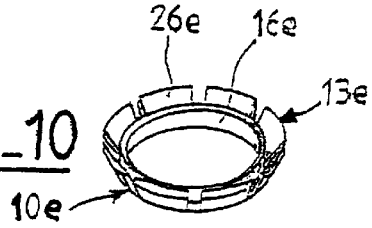
FIG. 10 is a view similar to that of FIG. 9 of a variant of the same flange.

In the example of FIG. 8, one finds external tube 7*d* which is formed inside with two longitudinal grooves 6*d*, covered by sleeve 8*d*, and internal tube 5*d* cut by two helicoidal slits 4*d* as in the example of FIG. 1. But in this case, the grooves and the slits open at the top, while the external tube has, at its base, annular fold 27*d* whose internal circular end is connected to the external lateral wall of open tubular extension 28*d* of internal tube 5*d* by nonlocking catching device 9*d*. On this same wall, attached by gluing or, preferably, welding, there is internal cylindrical wall 16*d* of flange 10*d* with a V-shaped cross section (FIG. 9) whose flexible frustrum-shaped external wall 13*d* bears elastically against beveled part 29*d* of the connection of the external wall of the external tube with its annular fold. Depending on the desired force of braking and compensation of play between the two tubes, flange 10*d* will be positioned more or less pushed in on the tubular extension before it is attached: thus, in the left half of FIG. 8, the flange is represented pushed in minimally and provides a minimum of force of braking and of compensation for play, whereas in the right half, it is represented pushed in maximally and provides a maximum effect. As a variant, as represented in FIG. 10, flexible external wall 13*e* of flange 10*e* is formed with a number of teeth 26*e* with a greater elasticity than continuous wall 13*d* of the flange of FIGS. 8 and 9.

Figure 11:
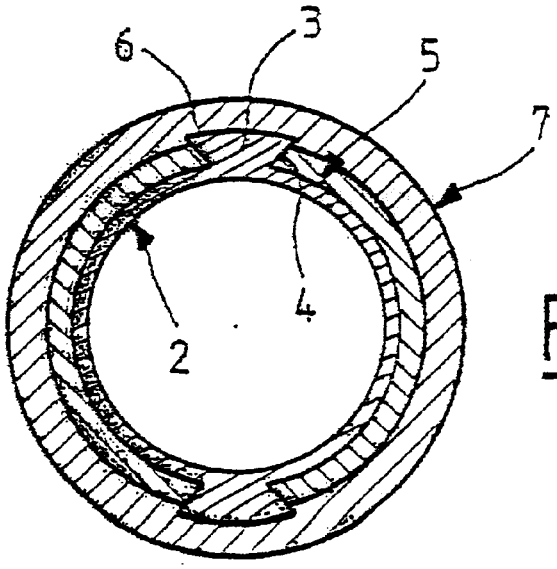
FIG. 11 is a diagrammatic view in diametral section of a cup-slider of a case according to the invention.

Mainly when it is the internal tube of the mechanism which is formed with helicoidal slits, as in the examples of FIGS. 1 and 8, there is the risk of deformation by expansion of the tube under the stress of the tongues of the cup-slider during manipulations of the case, which can possibly cause the tongues to escape from the grooves. It is possible to prevent this risk by giving grooves 6 and slits 4 of tubes 5, 7 walls with triangular cross sections complementary to those of tongues 3 of cup-slider 2, as represented in FIG. 11.

What is claimed is:

1. A case for lipstick and similar pasty substances in stick form, comprising:

an inner tube having a base portion;

an outer tube concentric with the inner tube and mounted for rotation therewith, the outer tube having a base portion, the base portion having a bottom annular edge;

an axially translatable cup disposed within the inner tube for carrying the pasty substance, the cup cooperating with the inner and outer tubes such that when the inner tube is rotated in the outer tube the cup axially translates; and an annular flange connected to the base portion of the inner tube and having at least one flexible extension bearing elastically and axially against the bottom annular edge of the outer tube such that rotational breaking occurs between the inner and outer tubes and axial play between the inner and outer tubes is compensated.

2. The case according to claim 1, wherein the flange has a solid bottom.

3. The case according to claim 1, wherein the flange has an axial tubular part having an open lower end for receiving a tube cap of a decorative envelope for the case.

4. The case according to claim 1, wherein a top of an external lateral wall of the flange has a plurality of overlying elastic arches.

5. The case according to claim 4, wherein the flange includes a ring surrounded by teeth having free ends joined by the elastic arches.

6. The case according to claim 1, wherein the flange has a generally V-shaped cross section having a solid interior arm which is connected to a tubular extension of the base of the inner tube, and having an exterior arm having elastic teeth which bear against an exterior frustrum-shaped part of the bottom edge of the outer tube.

7. The case according to claim 6, wherein the flange is fastened to the tubular extension of the inner tube a distance from the edge of the outer tube which is determined by the extent of the desired force of friction of the elastic teeth of the flange.

8. The case according to claim 1, wherein an internal wall of the outer tube is formed with two diametrically opposing longitudinal first grooves emerging only at a base of the outer tube, and the inner tube is cut by two diametrically opposing spiral slits each ending in a longitudinal slit, each of said longitudinal slits ending in a second groove formed in the internal wall of a reinforced continuous circular end of the inner tube.

9. The case according to claim 8, wherein the first grooves of the outer tube have lateral walls and the spiral slits of the internal tube include walls having triangular cross sections complementary to those of two diametrically opposing tongues of cup-slider and which mutually fit together for the axial movement of the cup-slider by rotation of the inner and outer tubes.

10. A case according to claim 1, wherein the inner and outer tubes are molded out of a polymer chosen from the group consisting of polypropylene and polystyrene, and the flange is molded out of a polymer chosen from the group consisting of polyoxymethylene, high-density polyethylene, and a fluorinated polymer.

11. The case according to claim 1, further including non-locking corresponding catches disposed on the base portion of said inner and outer tubes and rotatably connecting the inner and outer tubes, the non-locking corresponding catches permitting limited axial play between the inner and outer tubes.

* * * * *

UNITED STATES PATENT AND TRADEMARK OFFICE

CERTIFICATE OF CORRECTION

PATENT NO. : 6,109,808

DATED : August 29, 2000

INVENTOR(S) : Susini, et al.

It is certified that error appears in the above-identified patent and that said Letters Patent are hereby corrected as shown below:

Column 1, line 42, now reads: "2,169,557"
should read: --2,619,557--

Signed and Sealed this

First Day of May, 2001

*Attest:*

Nicholas P. Godici

NICHOLAS P. GODICI

*Attesting Officer*

*Acting Director of the United States Patent and Trademark Office*